US011346550B2

(12) United States Patent
Huang et al.

(10) Patent No.: US 11,346,550 B2
(45) Date of Patent: May 31, 2022

(54) BURNER OF GAS STOVE

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Wei-Long Chen, Taichung (TW); Kuan-Chou Lin, Taichung (TW); Tang-Yuan Luo, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 209 days.

(21) Appl. No.: 16/662,355

(22) Filed: Oct. 24, 2019

(65) Prior Publication Data

US 2021/0071863 A1 Mar. 11, 2021

(30) Foreign Application Priority Data

Jul. 30, 2019 (TW) ..... 108126887

(51) Int. Cl.
*F23D 14/06* (2006.01)
*F24C 3/08* (2006.01)

(52) U.S. Cl.
CPC ..... *F23D 14/06* (2013.01); *F24C 3/085* (2013.01); *F23D 2900/14062* (2013.01)

(58) Field of Classification Search
CPC ..... F23D 14/02; F23D 14/06; F23D 14/065; F23D 14/46; F23D 14/58; F23D 14/62;
(Continued)

(56) References Cited

U.S. PATENT DOCUMENTS 5,639,232 A * 6/1997 Bogenschutz ..... F23D 14/065 126/39 E
6,322,354 B1 * 11/2001 Carbone ..... F23D 14/02 126/39 E (Continued)

FOREIGN PATENT DOCUMENTS

CN 207080999 U * 6/2017 ..... F23D 14/02
CN 206695125 U * 12/2017 ..... F23D 14/02

(Continued)

OTHER PUBLICATIONS

Machine translation of Mai et al. (Year: 2017).*

(Continued)

*Primary Examiner* — Michael G Hoang
*Assistant Examiner* — David Jung Hyon Cho
(74) *Attorney, Agent, or Firm* — R. Lynette Wylie; Apex Juris, pllc.

(57) ABSTRACT

A burner of a gas stove includes a burner body, a partition member, and at least one flame cover. The burner body includes an inlet portion and a base. The inlet portion has at least one inlet passage for injecting gas and air, and the base has at least one mixture passage for mixing the gas and the air. The at least one mixture passage communicates with the at least one inlet passage. The partition member has a plurality of through holes and covers the at least one mixture passage. The at least one flame cover has a plurality of flame holes and covers the partition member. Whereby, the size of the burner of the gas stove could be reduced significantly, and the gas could mix with the air effectively and uniformly.

13 Claims, 9 Drawing Sheets

(58) Field of Classification Search
CPC ... F23D 2900/14062; F24C 3/08; F24C 3/085
USPC ..... 126/39 E
See application file for complete search history.

(56) References Cited

U.S. PATENT DOCUMENTS

| | | | | |
|---|---|---|---|---|
| 8,245,703 | B2 * | 8/2012 | Cadeau | F23D 14/06 126/39 E |
| 2010/0154776 | A1 * | 6/2010 | Czajka | F24C 3/085 126/39 E |
| 2018/0347808 | A1 * | 12/2018 | Trochou | F23D 14/06 |

FOREIGN PATENT DOCUMENTS

| | | | | |
|---|---|---|---|---|
| CN | 206695125 U | | 12/2017 | |
| CN | 207080999 U | | 3/2018 | |
| CN | 207350337 U | * | 5/2018 | F23D 14/02 |
| CN | 207350337 U | | 5/2018 | |
| GB | 2197063 A | * | 5/1988 | F23D 14/58 |
| TW | 258315 | | 9/1995 | |
| WO | WO-2016170497 A1 | * | 10/2016 | F23D 14/04 |

OTHER PUBLICATIONS

Machine translation of Haizhong et al. (Year: 2017).*
Machine translation of Zhongqun et al (Year: 2018).*
Examination report for TW108126887, dated Jan. 16, 2020, Total of 13 pages.
Search report for TW108126887, dated Jan. 16, 2020, Total of 1 page.
English Abstract for CN206695125, Total of 1 page.
English Abstract for CN207080999, Total of 1 page.
English Abstract for CN207350337, Total of 1 page.
English Abstract for TW258315, Total of 1 page.

* cited by examiner

BURNER OF GAS STOVE

BACKGROUND OF THE INVENTION

Technical Field

The present invention is related to a gas stove, and more particularly to a burner of a gas stove.

Description of Related Art

FIG. 1 depicts a conventional burner of a gas stove. The burner includes an outer ring member 1, an inner ring member 2, a first long tube 3, and a second long tube 4.

When gas and air pass through the first long tube 3 or the second long tube 4, the gas and the air mix together inside the first long tube 3 or inside the second long tube 4. The gas-air mixture flow passes through the first long tube 3 into the outer ring member 1 or through the second long tube 4 into the inner ring member 2 respectively. Then, the gas-air mixture flow is ejected from a plurality of flame holes 5 of the outer ring member 1 or those of the inner ring member 2 respectively. With an igniter (not shown), flames are generated by igniting and combusting the gas-air mixture flow.

However, to uniformly mix the gas with the air, a length of the first long tube 3 and that of the second long tube 4 are set to be at least 1 time longer than a diameter of the outer ring member 1, resulting in a bulky size of the conventional burner and inconvenience of package and shipping. Moreover, the burner with bulky size cannot be properly mounted on a smaller cooktop.

How to reduce the size of the conventional burner of the gas stove and achieve the effect of uniformly mixing the gas with the air has been the focus of today's design.

BRIEF SUMMARY OF THE INVENTION

In view of the above, the primary objective of the present invention is to provide a burner of a gas stove, which could uniformly mix gas with air and has a smaller size.

The present invention provides a burner of a gas stove, including a burner body, a partition member, and at least one flame cover. The burner body includes an inlet portion and a base. The inlet portion has at least one inlet passage for injecting gas and air. The base has at least one mixture passage for mixing the gas and the air. One end of the at least one mixture passage communicates with the at least one inlet passage, and the other end thereof is a closed end. The partition member is mounted on the base and covers the at least one mixture passage. The partition member has a plurality of through holes communicating with the at least one mixture passage, and the through holes are arranged along a circumferential direction of the at least one mixture passage. The at least one flame cover covers the partition member, and at least one chamber is formed between the at least one flame cover and the partition member. The at least one flame cover has a plurality of flame holes arranged in a ring shape. The flame holes communicate with the at least one chamber, and the at least one chamber communicates with the at least one mixture passage through the through holes of the partition member.

By disposing the at least one mixture passage in the base, the size of the burner of the gas stove is reduced significantly, and the gas can mix with the air effectively and uniformly.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
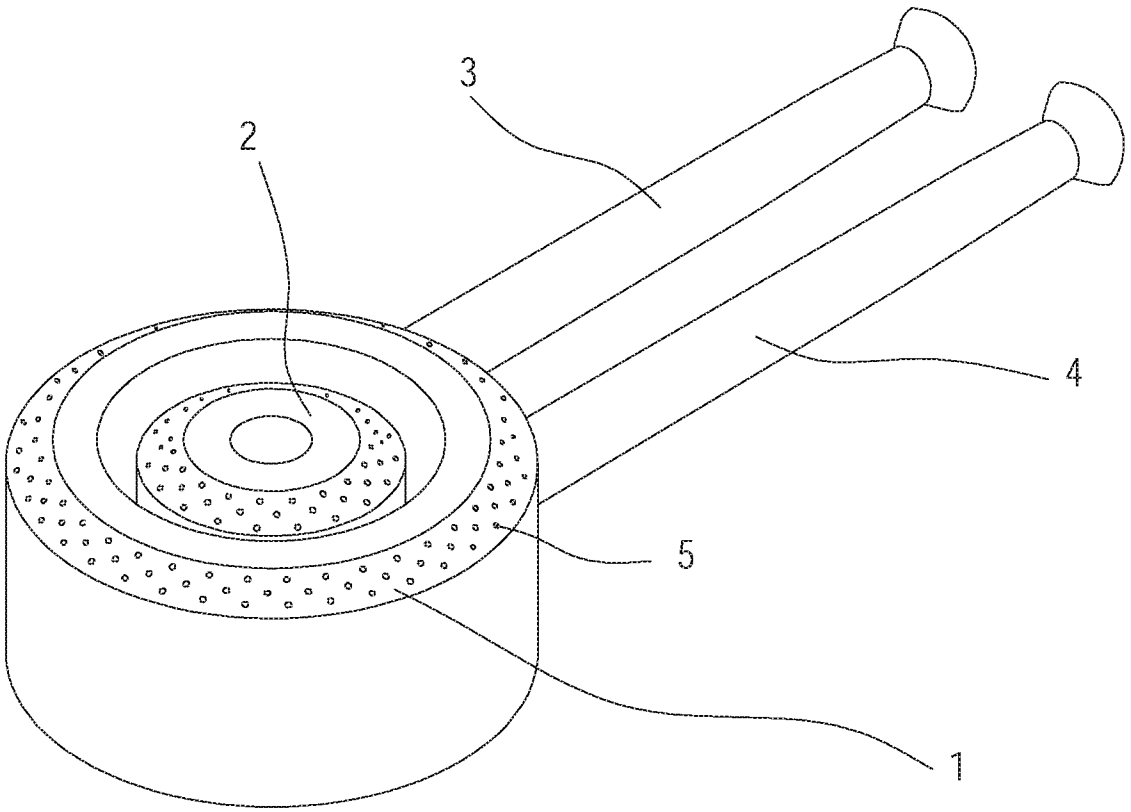
FIG. 1 is a perspective view of a conventional burner of a gas stove.
Figure 2:
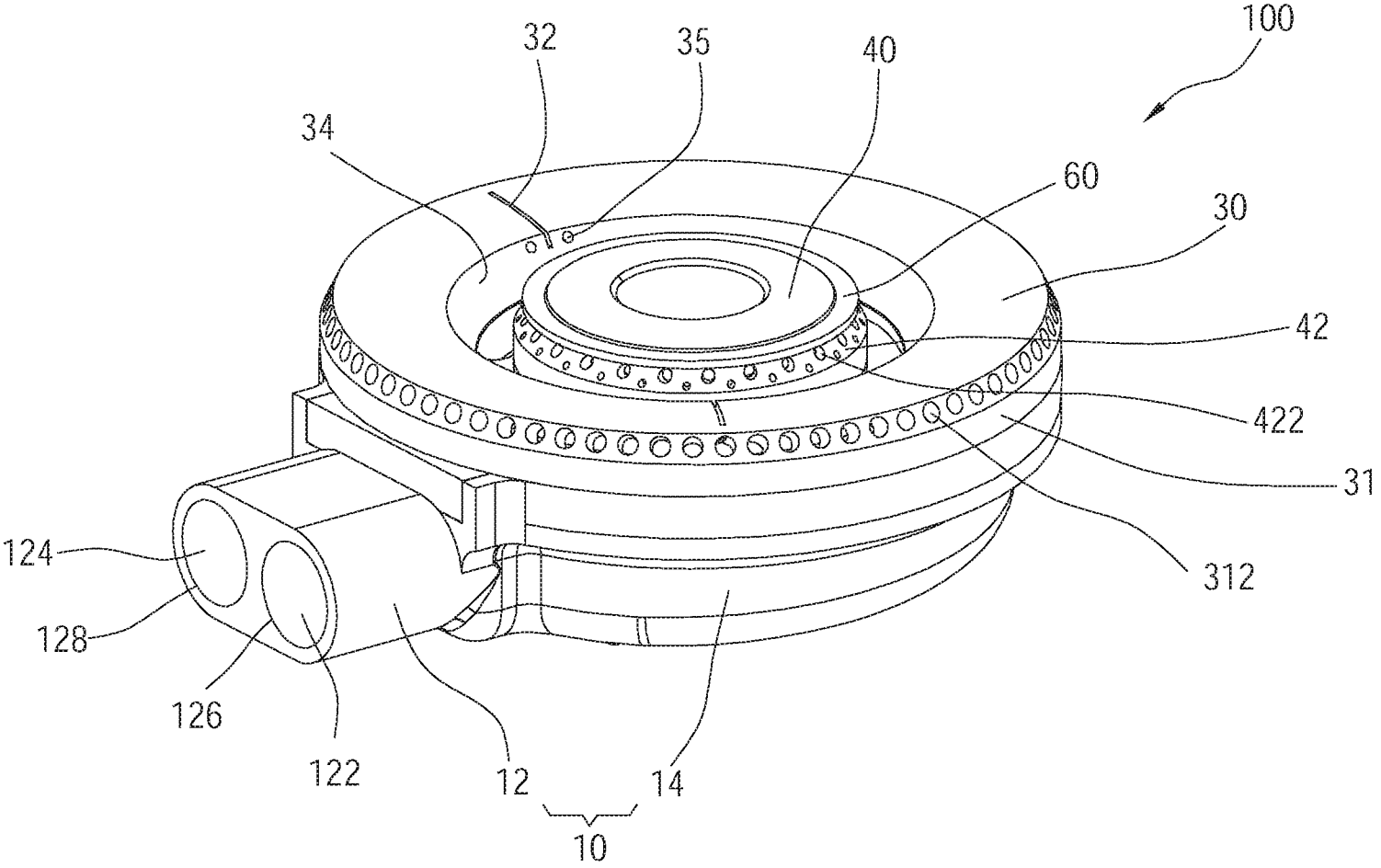
FIG. 2 is a perspective view of a burner of a gas stove of a preferred embodiment according to the present invention.
Figure 3:
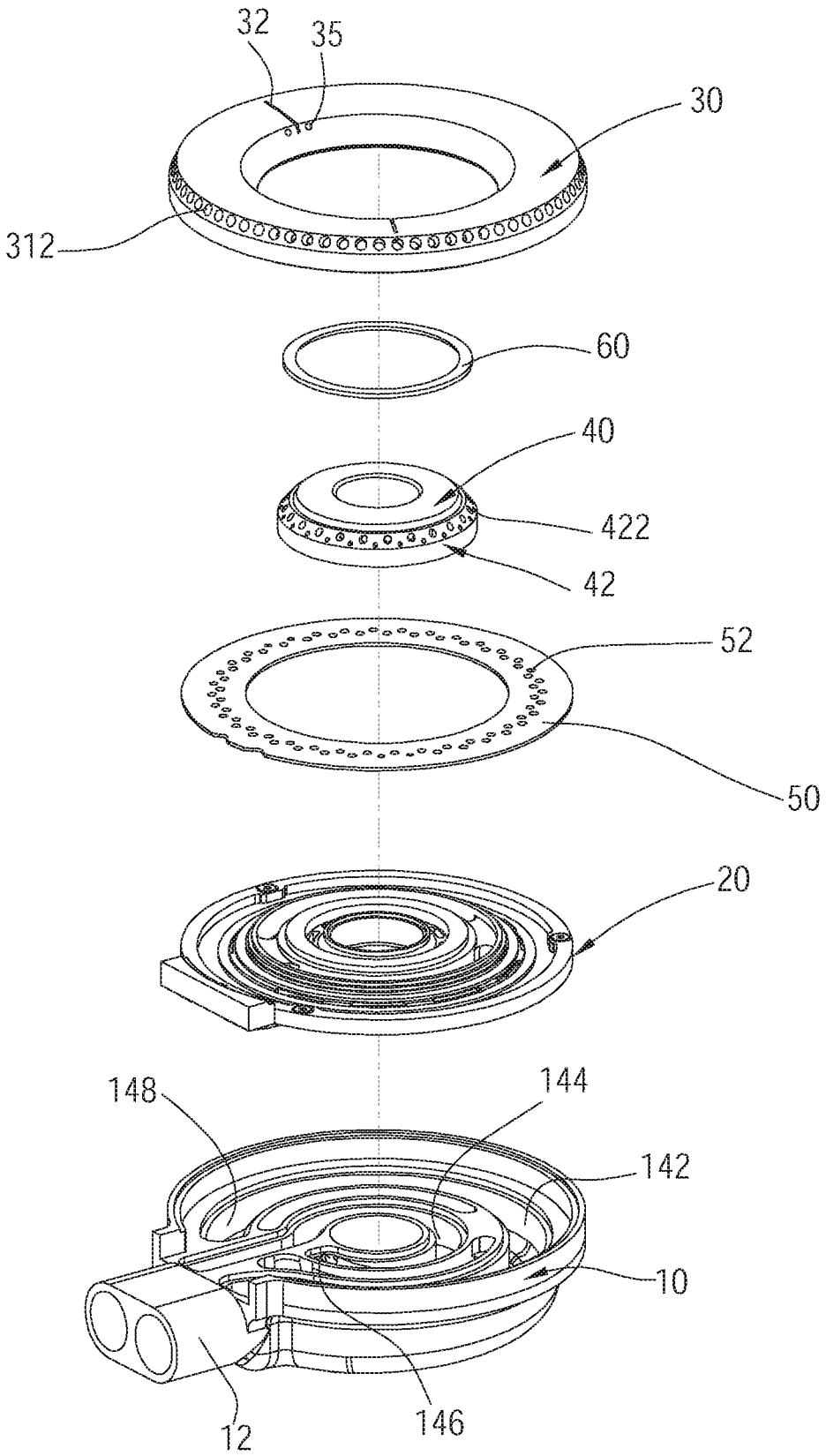
FIG. 3 is an exploded view of the burner of the gas stove of the preferred embodiment.

The following illustrative embodiments and drawings are provided to illustrate the disclosure of the present invention, these and other advantages and effects can be clearly understood by persons skilled in the art after reading the disclosure of this specification.

A burner 100 of a gas stove of a preferred embodiment according to the present invention is shown in FIG. 2 to FIG. 9. The burner 100 includes a burner body 10, a partition member 20, and at least one flame cover.

The burner body 10 includes an inlet portion 12 and a base 14 which are integrally formed. The inlet portion 12 has at least one inlet passage for injecting gas and air. The at least one inlet passage includes a plurality of inlet passages including a first inlet passage 122, and a second inlet passage 124. The first inlet passage 122 and the second inlet passage 124 extend along an axial direction of the inlet portion 12. The inlet portion 12 has two opposite ends in the axial direction. The first inlet passage 122 and the second inlet passage 124 form two inlets 126, 128 at one end of the inlet portion 12. Each inlet 126, 128 is configured to inject the gas and the air.

The base 14 has a disk shape and has two opposite ends on an extension line in the axial direction of the inlet portion 12, one end of the base 14 connected to the other end of the inlet portion 12. The base 14 has at least one mixture passage for mixing gas and air. The at least one mixture passage is in a ring shape and surrounds a center of the base. One end of the at least one mixture passage communicates with the at least one inlet passage, and the other end thereof is a closed end. In the current embodiment, the at least one mixture passage includes a plurality of mixture passages including an outer annular mixture passage 142, and an inner annular mixture passage 144. The outer annular mixture passage 142 and the inner annular mixture passage 144 both have open-ring shapes. One end of the outer annular mixture passage 142 communicates with the first inlet passage 122, and the other end thereof is a first closed end 146. The outer annular mixture passage 142 surrounds the inner annular mixture passage 144. One end of the inner annular mixture passage 144 communicates with the second inlet passage 124, and the other end thereof is a second closed end 148.

More specifically, a top of the base 14 has an engaging recess 149 under which are the outer annular mixture passage 142 and the inner annular mixture passage 144. A top of the outer annular mixture passage 142 and that of the inner annular mixture passage 144 are open and respectively communicate with the engaging recess 149. A bottom surface of the engaging recess 149 is recessed and forms two fitting grooves 149*a*, 149*b* respectively surrounding the top of the outer annular mixture passage 142 and the top of the inner annular mixture passage 144.

As shown in FIG. 5 to FIG. 8, a cross-sectional area of the outer annular mixture passage 142 decreases gradually in a direction from the end thereof communicating with the first inlet passage 122 to the closed end 146, and a bottom of the outer annular mixture passage 142 inclines upward in the direction from the end thereof communicating with the first inlet passage 122 to the first closed end 146. A cross-sectional area of the inner annular mixture passage 144 decreases gradually in a direction from the end thereof communicating with the second inlet passage 124 to the second closed end 148, and a bottom of the inner annular mixture passage 144 inclines upward in the direction from the end thereof communicating with the second inlet passage 124 to the second closed end 148.

Figure 4:
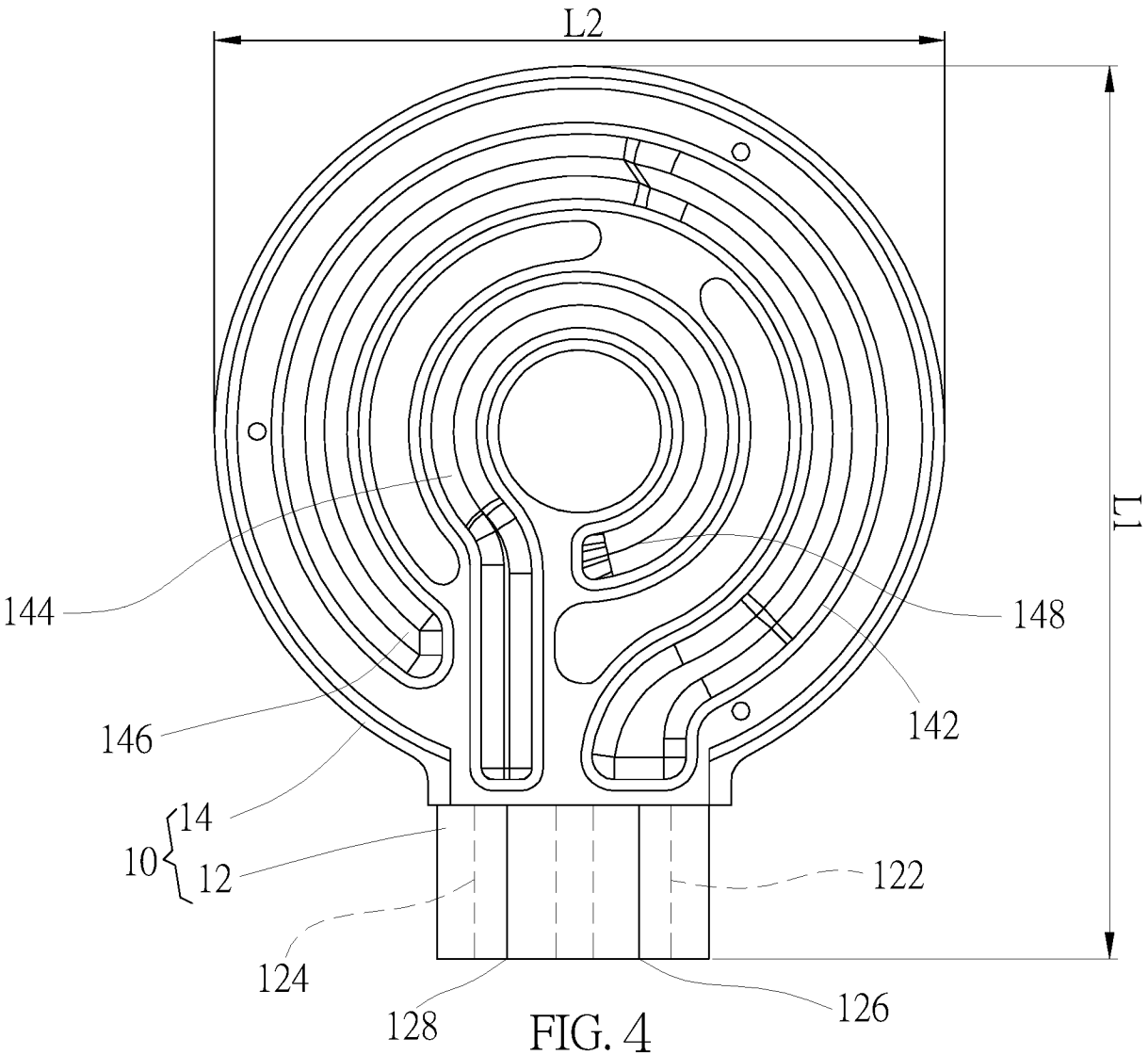
FIG. 4 is a top view of a burner body of the preferred embodiment.

As shown in FIG. 4, a length of the burner body 10 from the end of the inlet portion 12 with the two inlets 126, 128 to the corresponding end of the base 14 which is away from the two inlets 126, 128 is a first length L1, and a diameter of a maximum outer peripheral surface of the base 14 is a second length L2. The first length L1 is greater than the second length, and the first length L1 is preferably equal to or smaller than 1.5 times the second length L2. More preferably, the first length L1 is between 1.1 and 1.25 times the second length L2. Whereby, with the outer annular mixture passage 142 and the inner annular mixture passage 144 disposed in the base 14, the space occupied by the inlet portion 12 is reduced and the burner body 10 has a shorter length.

The partition member 20 is mounted on the base 14. More specifically, the partition member 20 is disposed in the engaging recess 149 of the base 14. As shown in FIG. 5 to FIG. 8, the partition member 20 includes an outer ring section 22 and an inner ring section 24 respectively covering the outer annular mixture passage 142 and the inner annular mixture passage 144. In the current embodiment, a bottom of the outer ring section 22 and that of the inner ring section 24 of the partition member 20 protrude and form two fitting rims 282, 284 which are respectively engaged with the two fitting grooves 149*a*, 149*b*. The shapes of the two fitting rims 282, 284 respectively match the shapes of the two fitting grooves 149*a*, 149*b*, so that the outer ring section 22 and the inner ring section 24 are fixedly engaged with the top of the outer annular mixture passage 142 and the top of the inner annular mixture passage 144.

As shown in FIG. 5 to FIG. 8, the partition member 20 has a plurality of through holes including a plurality of first through holes 222 and a plurality of second through holes 242. In the current embodiment, the outer ring section 22 has the first through holes 222 and a first annular groove 224. A top of the partition member 20 has a ring rim 26 surrounding the first annular groove 224, and the first through holes 222 are formed between the ring rim 26 and the first annular groove 224. The first through holes 222 are arc holes and spaced apart along a circumferential direction of the outer annular mixture passage 142. The first through holes 222 communicate with the outer annular mixture passage 142 through the first annular groove 224. The inner ring section 24 has a second annular groove 244 and the second through holes 242. The second through holes 242 are arc holes and located at an outer side of the second annular groove 244. The second through holes 242 are spaced apart along a circumferential direction of the inner annular mixture passage 144 and communicate with the inner annular mixture passage 144 through the second annular groove 244.

As shown in FIG. 2, FIG. 5, FIG. 7, and FIG. 8, the at least one flame cover includes a plurality of flame covers including an outer annular flame cover 30 and an inner annular flame cover 40. The outer annular flame cover 30 includes an outer ring side 31 and an inner ring side 34. The outer ring side 31 has a plurality of first flame holes 312 arranged in a ring shape, and the inner ring side 34 has at least one flame guide groove 32 and at least one flame guide hole 35. In the current embodiment, the at least one flame guide groove 32 includes a plurality of flame guide grooves 32 and the at least one flame guide hole 35 includes a plurality of flame guide holes 35. The outer annular flame cover 30 covers the outer ring section 22 of the partition member 20, and a first chamber 36 is formed between the outer annular flame cover 30 and the outer ring section 22. The first chamber 36 communicates with the first flame holes 312, the flame guide holes 35, and the flame guide grooves 32. One end of each flame guide groove 32 is located beside two flame guide holes 35, and the flame guide groove 32 extends in a direction from the inner ring side 34 to the outer ring side 31. The first chamber 36 communicates with the outer annular mixture passage 142 through the first through holes 222 of the partition member 20. In practice, the flame guide holes 35 and the flame guide grooves 32 may not be provided, or only one of the flame guide holes 35 and the flame guide grooves 32 may be provided.

In the current embodiment, a ring partition 50 is disposed between the outer annular flame cover 30 and the partition member 20 and is located in the first chamber 36. The ring partition 50 has a plurality of penetrating holes 52 arranged in a ring shape, whereby the gas-air mixture flow is concentrated and flows into the upper part of the first chamber 36 through the penetrating holes 52. In practice, the ring partition 50 may not be provided.

The inner annular flame cover 40 has an outer ring side 42 corresponding to the inner ring side 34 of the outer annular flame cover 30. The outer ring side 42 has a plurality of second flame holes 422 arranged in a ring shape. The inner annular flame cover 40 covers the inner ring section 24 of the partition member 20, and a second chamber 44 is formed between the inner annular flame cover 40 and the inner ring section 24. The second chamber 44 communicates with the inner annular mixture passage 144 through the second through holes 242 of the partition member 20. In the current embodiment, a cover ring 60 is disposed at the inner annular flame cover 40 and located above the second flame holes 422. In practice, the cover ring 60 may not be provided.

Figure 5:
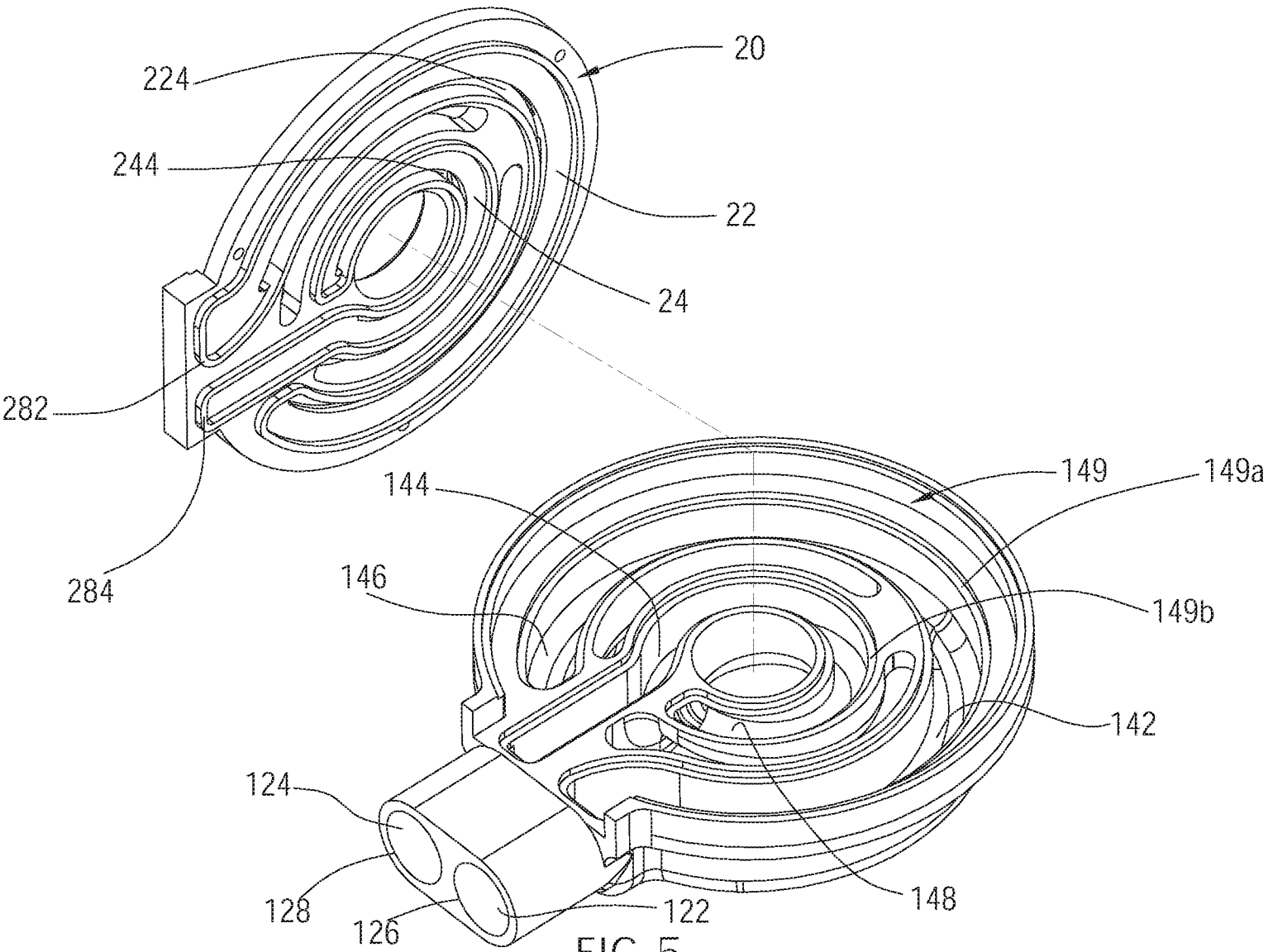
FIG. 5 is an exploded view of a partition member and the burner body of the preferred embodiment.
Figure 6:
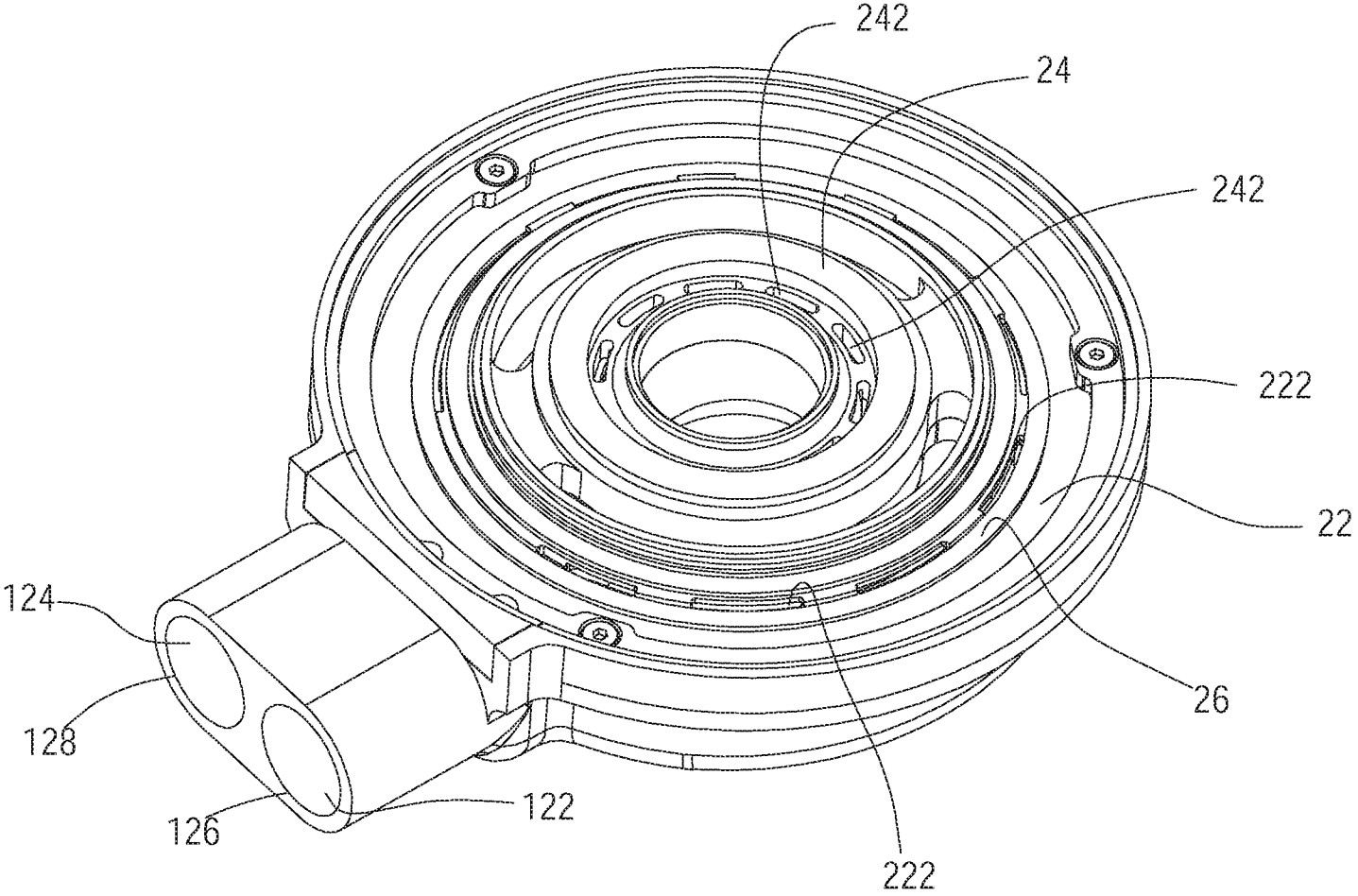
FIG. 6 is a perspective view of the partition member and the burner body.
Figure 7:
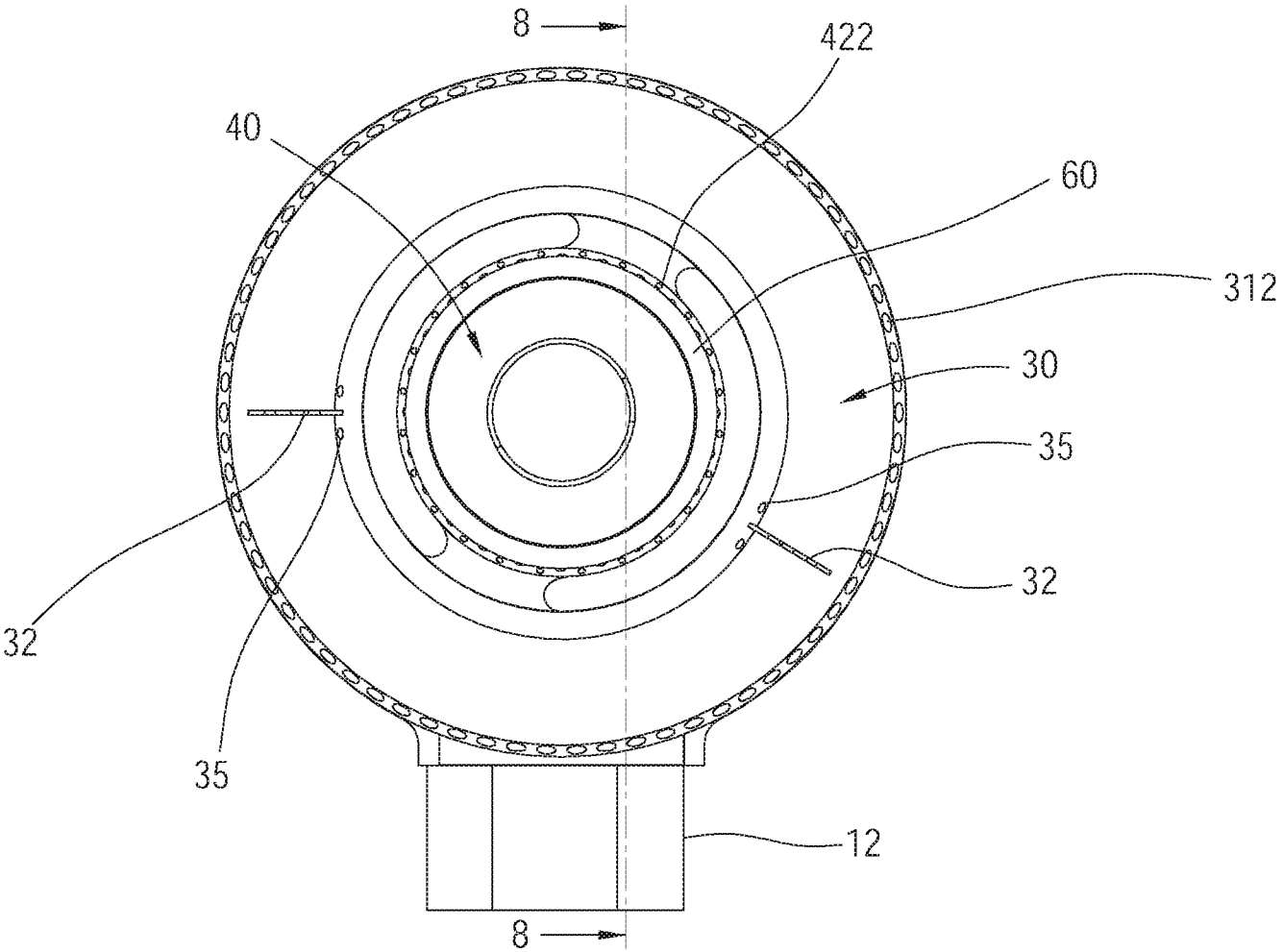
FIG. 7 is a top view of the burner of the gas stove of the preferred embodiment.
Figure 8:
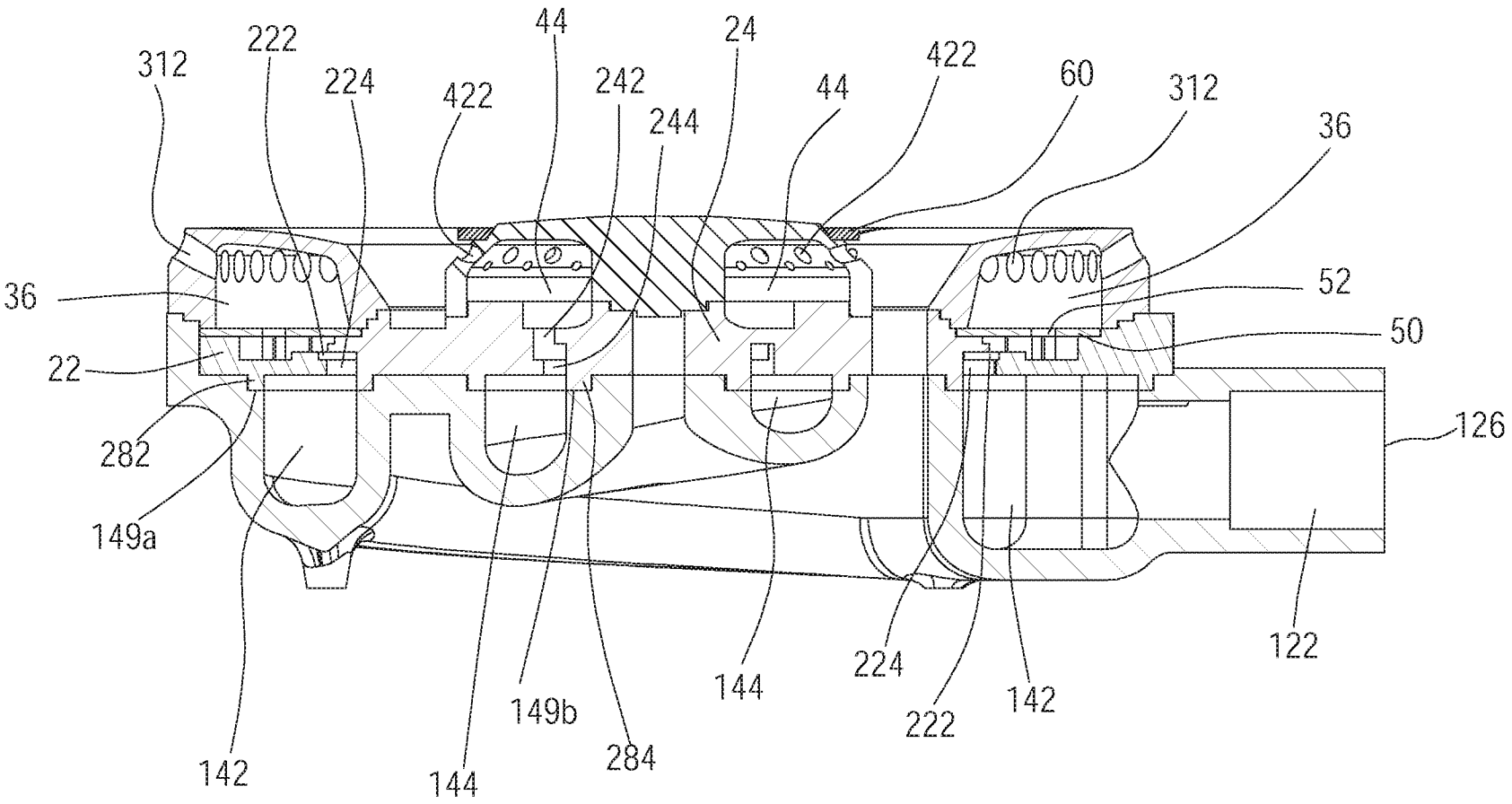
FIG. 8 is a cross-sectional view of FIG. 7 along line 8-8.
Figure 9:
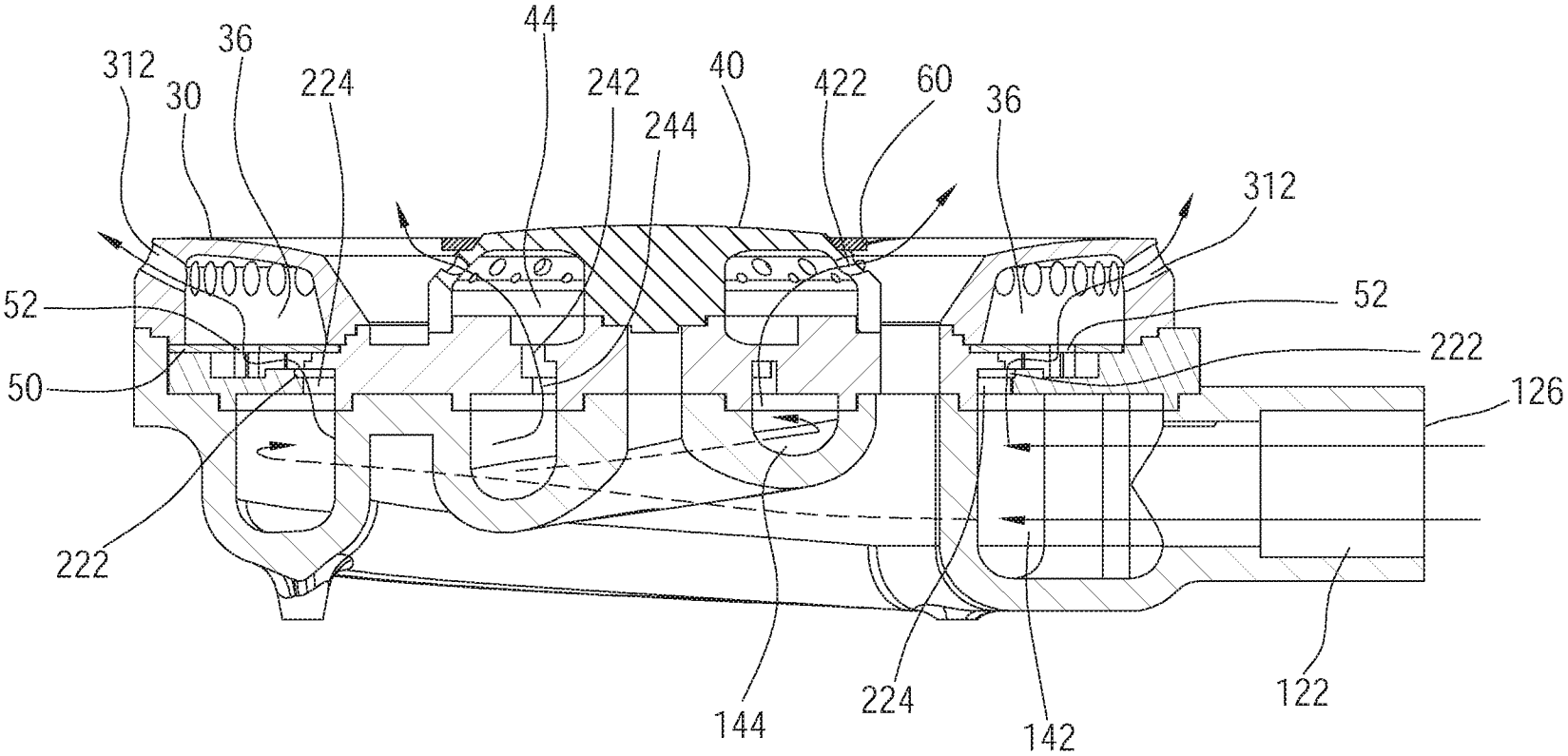
FIG. 9 is a schematic view showing that a gas-air mixture flow direction of the burner of the gas stove of the preferred embodiment.

The following description related to FIG. 5 and FIG. 9 depicts a gas-air mixture flow direction. The gas and air flow into the first inlet passage 122, form a gas-air mixture flow, then flow into the outer annular mixture passage 142. Meanwhile, the gas and air flow into the second inlet passage 124, form a gas-air mixture flow, then flow into the inner annular mixture passage 144. Since the cross-sectional area of outer annular mixture passage 142 and that of the inner annular mixture passage 144 decrease gradually, a pressure of the first closed end 146 and that of the second closed end 148 are greater than those of the inlets 126, 128, resulting in the gas-air mixture flows respectively flowing to the first closed end 146 and the second closed end 148, so that the gas mixes sufficiently with the air in the outer annular mixture passage 142 and the inner annular mixture passage 144. With the bottom of the outer annular mixture passage 142 and that of the inner annular mixture passage 144 inclining upward, the gas-air mixture flows are guided upwards smoothly.

The gas-air mixture flow in the outer annular mixture passage 142 passes through the first annular groove 224 and the first through holes 222 and flows into the lower part of the first chamber 36, then passes through the penetrating holes 52 of the ring partition 50 and flows into the upper part of the first chamber 36. The time which the gas-air mixture flow passes through the first chamber 36 is extended by the ring partition 50, so that the gas-air mixture flow forms a holding pressure in the first chamber 36 and then is output from the first flame holes 312, the flame guide grooves 32, and the flame guide holes 35.

The gas-air mixture flow in the inner annular mixture passage 144 passes through the second annular groove 244 and the second through holes 242 and then flows into the second chamber 44, so that the gas-air mixture flow output from the second flame holes 422 can be expanded outward by the cover ring 60.

An igniter (not shown) can be provided beside the flame guide holes 35 and the flame guide groove 32 for igniting the gas-air mixture flow output from the flame guide holes 35 and the flame guide groove 32. After igniting flames, the flames extend outward from the inner ring side 34 to the outer ring side 31 to ignite the gas-air mixture flow output from the first flame holes 312. Meanwhile, the igniter ignites the gas-air mixture flow output from the second flame holes 422. The flame guide groove 32 is designed to accelerate the time of igniting the gas-air mixture flow output from the first flame holes 312.

By disposing the outer annular mixture passage 142 and the inner annular mixture passage 144 in the base 14, the size of the burner 100 of the gas stove is reduced significantly, and the gas can mix with the air sufficiently with the help of annular mixture passages.

It must be pointed out that the embodiments described above are only some embodiments of the present invention. All equivalent structures which employ the concepts disclosed in this specification and the appended claims should fall within the scope of the present invention.

What is claimed is:

1. A burner of a gas stove, comprising:

a burner body including an inlet portion and a base, wherein the inlet portion has two inlet passages for injecting gas and air; the base has two mixture passages for mixing the gas and the air; the two mixture passages are annular; an end of each of the two mixture passages communicates with one of the two inlet passages, and another end of each of the two mixture passages is a closed end;

a partition member mounted on the base and covering the two mixture passages; wherein the partition member has a plurality of through holes communicating with the two mixture passages, and the plurality of through holes arranged along a circumferential direction of one of the two mixture passages; and two flame covers covering the partition member, wherein a chamber is formed between each of the two flame covers and the partition member; each of the two flame covers has a plurality of flame holes arranged in a ring shape and communicating with one of the chambers; the chambers communicate with the two mixture passages through the plurality of through holes of the partition member; wherein the inlet portion is disposed at a side surface of the base and does not protrude out of a bottom of the base, so that the gas and air flow into the base through the side surface of the base; a bottom of each of the two mixture passages is inclined upward, so that a cross-sectional area of each of the two mixture passages is gradually decreased from the end communicating to one of the two inlet passages all the way to the closed end;

wherein the base has two opposite ends, and the inlet portion has two opposite ends, wherein an end of the inlet portion is connected to one of the ends of the base; a length of the burner body from the other end of the inlet portion to the other corresponding end of the base is a first length; the base has a maximum outer peripheral surface, and a diameter of the maximum outer peripheral surface is a second length; the first length is equal to or smaller than 1.5 times the second length.

2. The burner of the gas stove of claim 1, wherein the two mixture passages includes an outer annular mixture passage and an inner annular mixture passage; the two inlet passages include a first inlet passage and a second inlet passage; an end of the outer annular mixture passage communicates with the first inlet passage, and another end of the outer annular mixture passage is a first closed end; an end of the inner annular mixture passage communicates with the second inlet passage, and another end of the inner annular mixture is a second closed end; the outer annular mixture passage surrounds the inner annular mixture passage.

3. The burner of the gas stove of claim 2, wherein the partition member has an outer ring section and an inner ring section; the plurality of through holes includes a plurality of first through holes and a plurality of second through holes; the outer ring section and the inner ring section respectively cover the outer annular mixture passage and the inner annular mixture passage; the plurality of first through holes are arranged along a circumferential direction of the outer annular mixture passage, and the plurality of second through holes are arranged along a circumferential direction of the inner annular mixture passage.

4. The burner of the gas stove of claim 3, wherein the two flame covers includes an inner annular flame cover and an outer annular flame cover, the two chambers includes a first chamber and a second chamber; the outer annular flame cover covers the outer ring section of the partition member, and the first chamber is formed between the outer annular flame cover and the outer ring section; the inner annular flame cover covers the inner ring section of the partition member, and the second chamber is formed between the inner annular flame cover and the inner ring section; the outer annular flame cover includes a plurality of first flame holes arranged in a ring shape, the plurality of first holes communicate with the first chamber, and the first chamber communicates with the outer annular mixture passage through the plurality of first through holes of the partition member; the inner annular flame cover includes a plurality of second flame holes arranged in a ring shape; the plurality of second holes communicate with the second chamber, and the second chamber communicates with the inner annular mixture passage through the plurality of second through holes of the partition member.

5. The burner of the gas stove of claim 4, wherein the outer ring section has a first annular groove extending along the circumferential direction of the outer annular mixture passage, and the plurality of first through holes are located at an outer side of the first annular groove and communicate with the outer annular mixture passage through the first annular groove.

6. The burner of the gas stove of claim 5, wherein a top of the partition member has a ring rim surrounding the first annular groove, and the plurality of first through holes are formed between the ring rim and the first annular groove.

7. The burner of the gas stove of claim 4, wherein the inner ring section has a second annular groove extending along the circumferential direction of the inner annular mixture passage, and the plurality of second through holes are located at an outer side of the second annular groove and communicate with the inner annular mixture passage through the second annular groove.

8. The burner of the gas stove of claim 4, wherein a top of the base has an engaging recess recessed thereinto; a top of the outer annular mixture passage and a top of the inner annular mixture passage respectively communicate with the engaging recess, and the partition member is engaged with the engaging recess.

9. The burner of the gas stove of claim 8, wherein a bottom surface of the engaging recess is recessed and forms two fitting grooves respectively surrounding the top of the outer annular mixture passage and the top of the inner annular mixture passage, and a bottom of the partition member protrudes and forms two fitting rims respectively protruding into the two fitting grooves.

10. The burner of the gas stove of claim 4, wherein the outer annular flame cover has an outer ring side and an inner ring side; the plurality of first flame holes are located at the outer ring side; the inner ring side has at least one flame guide hole communicating with the first chamber; the inner annular flame cover has an outer ring side corresponding to the inner ring side of the outer annular flame cover, and the plurality of second flame holes are located at the outer ring side of the inner annular flame cover.

11. The burner of the gas stove of claim 10, wherein the outer annular flame cover has a flame guide groove communicating with the first chamber; an end of the flame guide groove is located beside the at least one flame guide hole, and the flame guide groove extends in a direction from the inner ring side of the outer annular flame cover to the outer ring side of the outer annular flame cover.

12. The burner of the gas stove of claim 10, further comprising a cover ring disposed at the inner annular flame cover and located above the plurality of second flame holes.

13. The burner of the gas stove of claim 4, further comprising a ring partition disposed between the outer annular flame cover and the partition member and located in the first chamber, wherein the ring partition has a plurality of penetrating holes arranged in a ring shape.

* * * * *